US005388510A

United States Patent [19]

Hansson

[11] Patent Number: 5,388,510

[45] Date of Patent: Feb. 14, 1995

[54] SPRAY DAMPENER FOR A PRINTING PRESS

[75] Inventor: Birger Hansson, Åkarp, Sweden

[73] Assignee: Jimek International AB, Malmo, Sweden

[21] Appl. No.: 227,374

[22] Filed: Apr. 14, 1994

[30] Foreign Application Priority Data

Apr. 23, 1993 [SE] Sweden ..... 9301361-3

[51] Int. Cl.[6] ..... B41F 7/30

[52] U.S. Cl. ..... 101/147

[58] Field of Search ..... 101/147, 148, 132.5, 101/366, 365; 118/301

[56] References Cited

U.S. PATENT DOCUMENTS 3,143,065 8/1964 Warczak .

5,014,615 5/1991 Lin et al. ..... 101/147

5,299,495 4/1994 Schoeps et al. .

*Primary Examiner*—J. Reed Fisher

*Attorney, Agent, or Firm*—Laurence R. Brown

[57] ABSTRACT

A spray dampener for a printing press has a row of spray nozzles (5) for spraying liquid on a roller (3). A shutter device (14) for mechanically screening off part of or the whole spray cone is arranged at a nozzle towards the end of the roller. The shutter device is a shield (14), attached to a shaft (11) rotatably arranged at the side of the nozzle facing the end of the roller.

5 Claims, 2 Drawing Sheets

SPRAY DAMPENER FOR A PRINTING PRESS

TECHNICAL FIELD

This invention relates to a spray dampener for a printing press, comprising in a housing a row of spray nozzles for spraying a liquid on a roller in the printing press, the row being substantially parallel with the roller axis, wherein a shutter device for mechanically screening off part of or a whole spray cone is arranged at a nozzle towards the end of the housing.

BACKGROUND OF THE INVENTION

Spray dampeners are commercially available and are used to spray a fountain solution mixed with water on a roller in a printing press, preferably an offset press, in precisely controlled amounts in order i.a. to increase the printing quality and reduce the ink consumption.

It is already known to provide means for controlling the supply of fountain solution mixed with water to the nozzles in dependence of certain factors, such as the operating speed of the printing press. However, if the paper web to be printed in the printing press has a smaller width than the roller sprayed by the nozzles of the spray dampener, the water sprayed on the roller outside the width corresponding to the paper web width may cause disadvantages.

In order to ensure that only a roller width corresponding to the paper web width is fully dampened by the spray dampener nozzles, shutter devices of the kind shown in US-A-4 831 927 (see FIG. 6) may be employed.

THE INVENTION

The main object of the invention is to provide improved means for screening off a spray cone at a spray dampener.

This is according to the invention attained in that the shutter device is a shield, attached to an externally rotatable shaft, arranged in the housing at the side of the nozzle facing the end of the housing. Hereby an adjustment of the spray width may be performed from the outside without any need for tools.

By a device as described the purpose of preventing dampening liquid to reach the roller outside the paper web width is obtained. However, for different reasons it may be preferred to allow a certain amount of liquid to reach the screened off portion of the roller. This may according to the invention be obtained in that the shield is provided with holes, allowing a certain amount of the sprayed liquid to reach the roller at the screened off portion. The size of these holes may in a certain embodiment be controlled.

The shaft for the shield may be turned either by means of a handle or a motor so as to adjust the angular position of the shield in accordance with the desired spray width.

THE DRAWING

The invention will be described in further detail below under reference to the accompanying drawing, in which FIG. 1 is a simplified perspective view of a conventional spray dampener arrangement with part of the spray dampener housing broken away for revealing the interior of the spray dampener, FIG. 2 is a top view of a spray nozzle in the spray dampener with a manually controlled device according to the invention, FIG. 3 is a side view from the left in FIG. 2, and FIG. 4 is a view corresponding to FIG. 3 but showing a motor-driven device according to the invention.

DETAILED DESCRIPTION OF PREFERRED EMBODIMENTS

Figure 1:
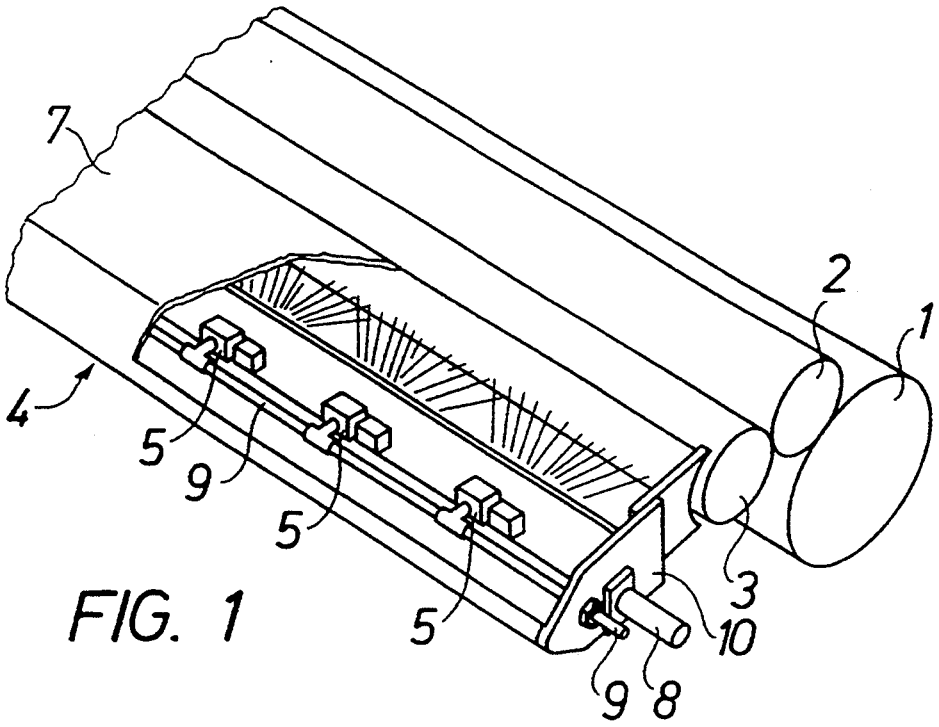

A portion of a printing press is shown in FIG. 1, namely a plate cylinder roller 1, a water-form roller 2 and a dampener roller 3. A spray dampener arrangement 4 is arranged adjacent the dampener roller 3 for emitting a pulsating spray of fluid, preferably fountain solution mixed with water, onto the dampener roller 3 for transferral to the water-form roller 2 and the plate cylinder roller 1.

The spray dampener arrangement 4 comprises a number of spray nozzles 5 arranged in a row in a spray bar 6 in a housing 7, which is mounted in a printing press frame by means of attachments 8. Pressurized liquid is provided to the nozzles 5 through a common conduit 9, and there are also electrical means (not shown) in the housing 7 for controlling the nozzles 5.

Figure 2:
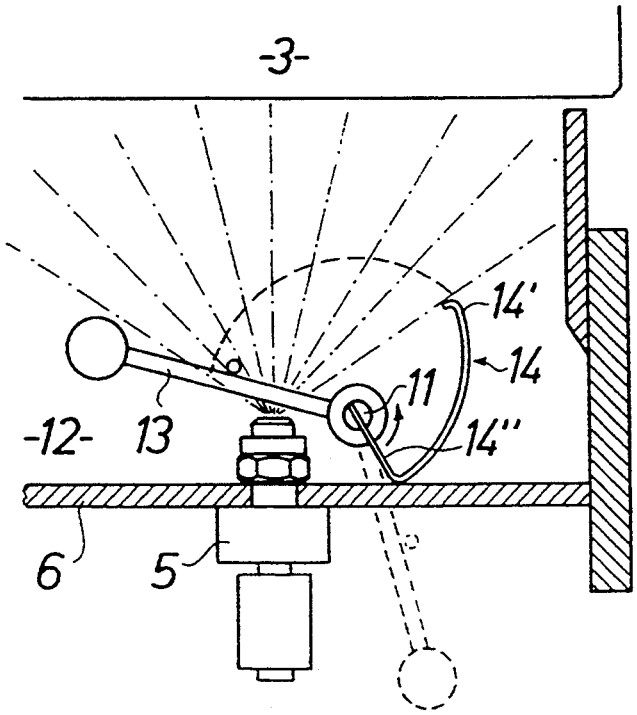

FIG. 2 is a top view of the nozzle 5 closest to the right hand end of the spray bar 6 at a side wall 10 of the housing 7. If a paper web in the printing press does not extend as far out as to the end of the dampener roller 3, it may be desired not to spray liquid on that portion of the roller. A device for restricting the spray width of the nozzle 5 shall now be described.

A shaft 11 is rotatably mounted in a bottom wall 12 of the housing 7 and may be turned by means of a handle 13 underneath the bottom wall 12. A shield 14 is mounted at the upper end of the shaft 11. This shield consists of a curved main part 14' and a connection part 14''. By turning the handle 13 the main part 14' of the shield 14 may be brought into the spray cone from the nozzle 5 and prevent sprayed liquid from reaching the roller 3 starting from its right hand end as depicted in FIGS. 1 and 2. By turning the handle 13 about 120° to the position shown in dashed lines in FIG. 2 the shield 14 will reach the position likewise shown in dashed lines and completely screening off the spray cone of the nozzle 5.

The main part 14' of the shield 14 may be provided with holes 15 so as to allow a certain proportion of the sprayed liquid to reach the roller 3, even if the shield 14 is in a screening off position in the spray cone of the nozzle 5. The main part 14' of the shield 14 may be provided with a slidable cover 20, which has a hole pattern like the main part, so that the size of the resulting holes 15 and accordingly the amount of liquid to reach the roller 3 may be controlled.

Figure 4:
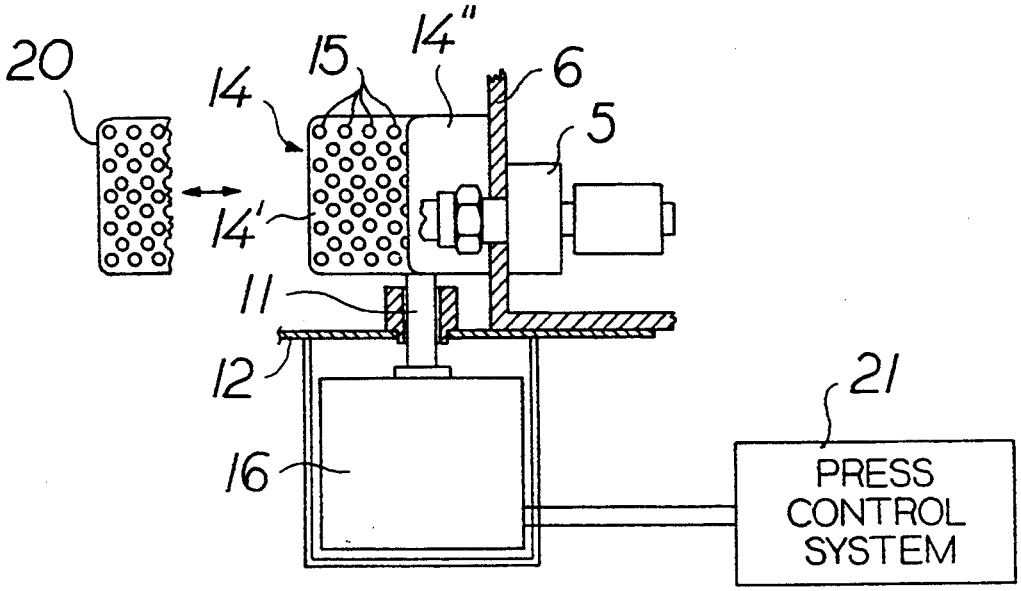

As an alternative to providing for manual control of the position of the shield 14 by means of the handle 13 the shaft 11 may underneath the bottom wall 12 be connected to an electric motor 16, as shown in FIG. 4.

Figure 3:
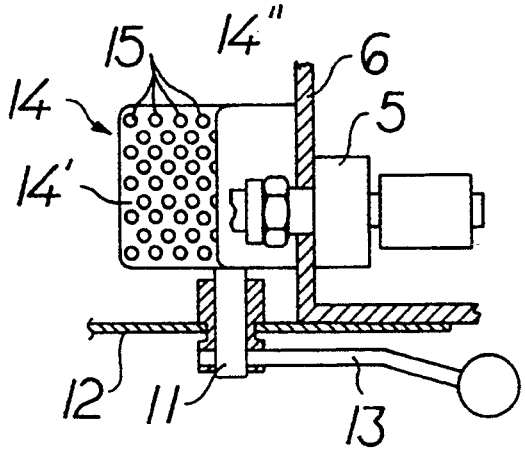

If necessary due to the possible use of narrow paper webs in the printing press more than one nozzle 5 at each end of the spray bar 6 may need to be provided with a shield 14. The respective positions of the shields 14 at each end of the spray bar 6 may be synchronized either mechanically in the case of the embodiment of FIGS. 2 and 3 or electrically in the case of the embodiment of FIG. 4. The motor 16 in the FIG. 4 embodiment may be controlled by a central press control system for the printing press 21, so that the input into this system of the paper web width will automatically result in a proper shielding off of nozzles 5 at each end of the spray bar.

In special cases, where the paper web used in the printing press is permanently narrower than the width of the roller 3, the position of the shield 14 may be fixed. Still, this shield 14 may be provided with the holes 15, the size of which may be variable in the above referenced manner.

We claim:

1. In a spray dampener system for a printing press, comprising in a housing (7) a row of spray nozzles (5) for spraying a liquid on a roller (3) in the printing press, the row being substantially parallel with the roller axis, wherein a shutter device (14) for mechanically screening off part of or a whole spray cone is arranged at a nozzle towards the end of the housing, the improvement further comprising: the shutter device is a shield (14), an externally rotatable shaft (11), and said shield is a substantially partially cylindrical shaped curved self supporting member coaxially disposable about the shaft in an arc defined by rotation of the shaft, arranged in the housing (7) at the side of the nozzle (5) facing the end of the housing to intercept spray about an arc defined by said shield and the rotational position of the shaft.

2. A spray dampener according to claim 1, wherein the shield (14) is provided with holes (15).

3. A spray dampener according to claim 2, wherein the size of the holes (15) are controlled.

4. A spray dampener according to claim 1, wherein the shaft (11) is turned by means of a motor (16).

5. A spray dampener according to claim 4, wherein the motor (16) is controlled by a central press control system for the printing press.

* * * * *